US007674132B1

(12) United States Patent
Chen

(10) Patent No.: US 7,674,132 B1
(45) Date of Patent: Mar. 9, 2010

(54) ELECTRICAL CONNECTOR ENSURING EFFECTIVE GROUNDING CONTACT

(75) Inventor: Yi-Hsiang Chen, Taipei (TW)

(73) Assignee: EZCONN Corporation, Taipei (TW)

( * ) Notice: Subject to any disclaimer, the term of this patent is extended or adjusted under 35 U.S.C. 154(b) by 0 days.

(21) Appl. No.: 12/385,905

(22) Filed: Apr. 23, 2009

(51) Int. Cl.
*H01R 9/05* (2006.01)

(52) U.S. Cl. ..... 439/578

(58) Field of Classification Search ..... 439/578–585
See application file for complete search history.

(56) References Cited

U.S. PATENT DOCUMENTS 6,790,081 B2 * 9/2004 Burris et al. ..... 439/578
7,128,603 B2 * 10/2006 Burris et al. ..... 439/578
7,288,002 B2 * 10/2007 Rodrigues et al. ..... 439/578
7,371,113 B2 * 5/2008 Burris et al. ..... 439/578
7,455,549 B2 * 11/2008 Rodrigues et al. ..... 439/578

* cited by examiner

*Primary Examiner*—Gary F. Paumen
(74) *Attorney, Agent, or Firm*—Rosenberg, Klein & Lee

(57) ABSTRACT

An electric connector ensuring effective grounding contact includes coaxially arranged inner sleeve and outer sleeve and a conductive grounding element. The inner sleeve is adapted to receive a central conductor and an insulating spacer of a cable therein, and can be axially rearward moved from a first position to a second position, and the outer sleeve is adapted to receive a braided conductive grounding sheath and an insulating sheath of the cable therein. The conductive grounding element is externally immovably fitted around the inner sleeve. When a stripped free end of the cable is inserted into the connector and the cable is rearward pulled, the inner sleeve is simultaneously rearward moved from the first position to the second position, forcing the inner sleeve, the conductive grounding element, and a connecting ring coaxially mounted around the inner sleeve to electrically contact with one another.

3 Claims, 5 Drawing Sheets

ELECTRICAL CONNECTOR ENSURING EFFECTIVE GROUNDING CONTACT

FIELD OF THE INVENTION

The present invention relates to a connector, and more particularly to an electrical connector having structure ensuring effective grounding contact.

BACKGROUND OF THE INVENTION

In signal transmission applications, the selection of a coaxial cable for carrying the signal is usually determined according to the distance between two points to be connected, the signal frequency, the maximum bend radius required, and the connector space available in a particular transmitting and/or receiving device. The longer the coaxial cable is and the higher the signal frequency is, the larger the outside diameter of the coaxial cable needs to be to prevent excessive signal loss. Conventionally, coaxial cables that are applied in cable TV transmission, broadband data transmission, and microwave signal transmission usually have an outer diameter ranged from 0.25 to 1 inch when the transmission distance is between 50 and 1000 feet.

A coaxial connector is well-known in the technological field of coaxial cable transmission. Typically, a coaxial connector is connected to a mating interface connector, so that a coaxial cable connected to the coaxial connector can be electrically connected to various kinds of electronic devices.

The conventional connector for a coaxial cable has some disadvantages. For instance, to ensure good electric signal transmission, it is a must a braided conductive grounding sheath of the coaxial cable is in good contact with a main body of the connector. However, with the conventional coaxial connector technique, poor grounding contact might occur between different components, such as an inner sleeve and a collar, of the connector to result in interrupted signal transmission. FIG. 1A is a sectional view of an F-series connector 10, being illustrated as a representative example of the conventional connectors. The F-type connector 10 includes an outer sleeve 11, a collar 12 coaxially fitted in the outer sleeve 11, an inner sleeve 13 axially movably fitted in the collar 12, and a nut-shaped connecting ring 14 rotatably mounted around the collar 12.

As can be seen in FIG. 1B, a free end of a cable 15 can be inserted into the connector 10, such that a central conductor 16 and an insulating spacer 17 of the cable 15 are received in the inner sleeve 13 while a braided conductive grounding sheath 18 and an insulating sheath 19 of the cable 15 are located in an annular space between the outer sleeve 11 and the inner sleeve 13, allowing the cable 15 to be connected to the connector 10. When the free end of the cable 15 has been fully inserted into the connector 10, the cable 15 can be pulled with a sufficient force to compel the inner sleeve 13 to move from a first position closer to a front end of the connecting ring 14 to a second position closer to a rear end of the connecting ring 14, so that the inner sleeve 13 and the collar 12 are in effective grounding contact, and the outer sleeve 11 is tightly connected at a radially inward annular rib 111 thereof to the insulating sheath 19 of the cable 15.

However, in the event the pull applied to the cable 15 is insufficient, a space S will exist between the inner sleeve 13 and the collar 12, resulting in poor contact between the inner sleeve 13 and the collar 12. The poor contact between the inner sleeve 13 and the collar 12 will further degrade the electrical characteristic of the connector 10. It is obviously necessary to overcome such poor contact between the inner sleeve 13 and the collar 12 of the connector 10.

Therefore, it is tried by the inventor to develop a connector, which not only ensures effective connection of the connector main body to a coaxial cable, but also ensure good grounding contact between components in the connector main body over a long period of time, so as to maintain the cable and the connector in good electrical characteristic.

SUMMARY OF THE INVENTION

A primary object of the present invention is to provide an electrical connector, which includes a conductive grounding element to establish stable grounding contact between internal components of the connector, so as to ensure good signal transmission quality and maintain the connector in good electrical characteristic.

To achieve the above and other objects, the electrical connector ensuring effective grounding contact according to the present invention includes coaxially arranged inner sleeve and outer sleeve and a conductive grounding element. The inner sleeve is adapted to receive a central conductor and an insulating spacer of a cable therein, and can be axially rearward moved from a first position to a second position, and the outer sleeve is adapted to receive a braided conductive grounding sheath and an insulating sheath of the cable. The conductive grounding element is externally immovably fitted around the inner sleeve. When a stripped free end of the cable is inserted into the connector and the cable is rearward pulled, the inner sleeve is simultaneously rearward moved from the first position to the second position, forcing the inner sleeve, the conductive grounding element, and a connecting ring coaxially mounted around the inner sleeve to electrically contact with one another.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
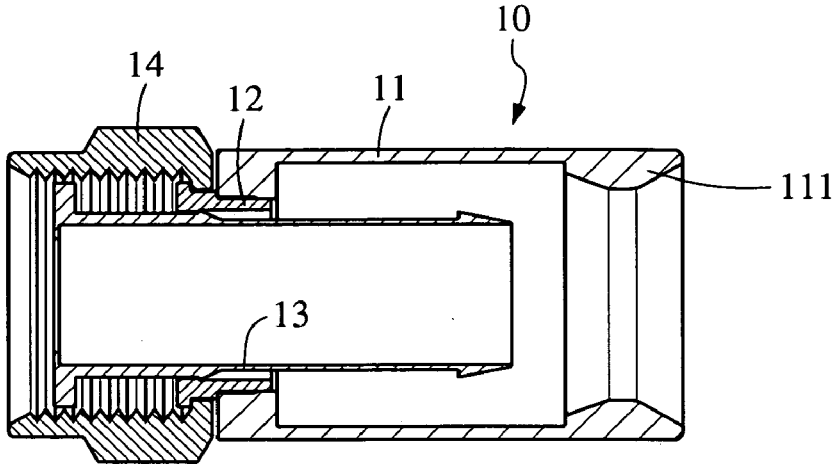
FIG.1 A PRIOR ART
FIG. 1A is a sectional view of a conventional connector.
Figure 1B:
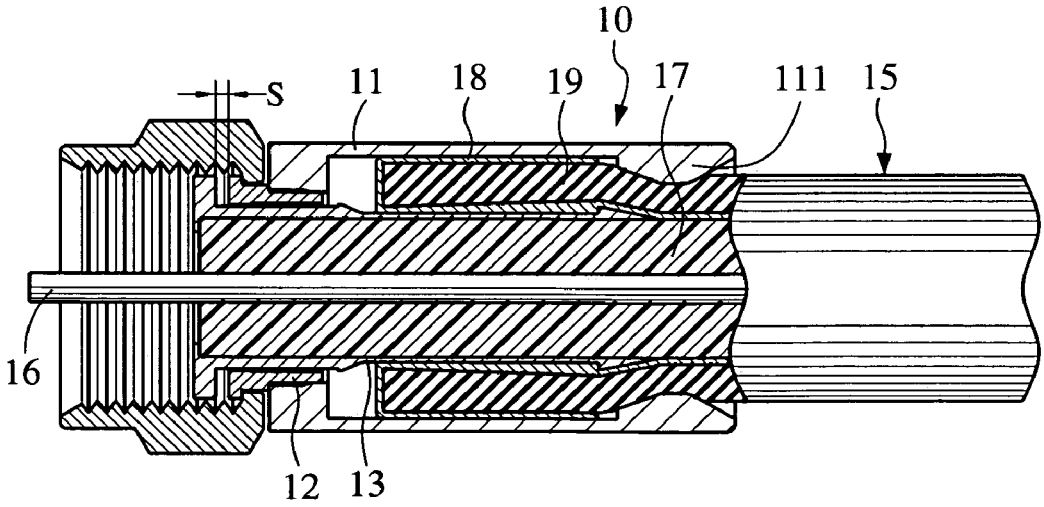
FIG.1 B PRIOR ART
FIG. 1B is a sectional view showing the connection of a coaxial cable to the conventional connector of FIG. 1A.
Figure 2:
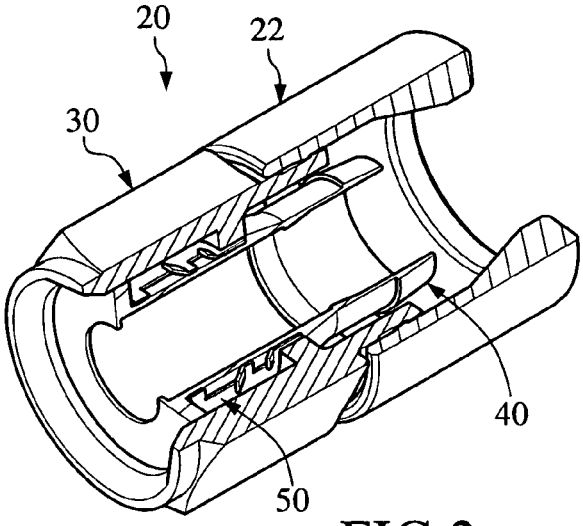
FIG. 2 is an assembled cutaway perspective view of an electrical connector ensuring effective grounding contact according to a preferred embodiment of the present invention.

In the following description of the present invention, for the purpose of easy to understand, elements that are the same in the accompanying drawings are denoted by the same reference numerals. Please refer to FIGS. 2 and 3 that are assembled cutaway perspective view and assembled sectional view, respectively, of an electrical connector ensuring effective grounding contact according to a preferred embodiment of the present invention. As shown, the electrical connector is generally denoted by reference numeral 20, and includes an outer sleeve 22, a connecting ring 30, an inner sleeve 40, and a conductive grounding element 50.

Figure 4:
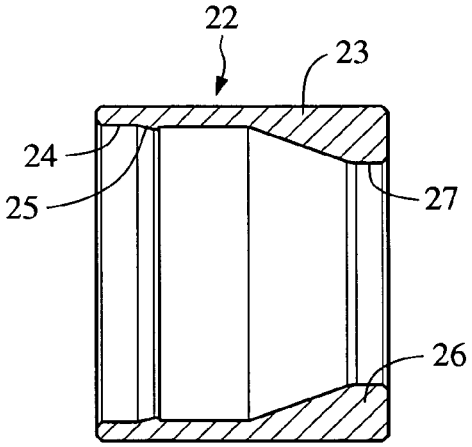
FIG. 4 is a sectional view of an outer sleeve included in the electrical connector of the present invention.
Figure 8A:
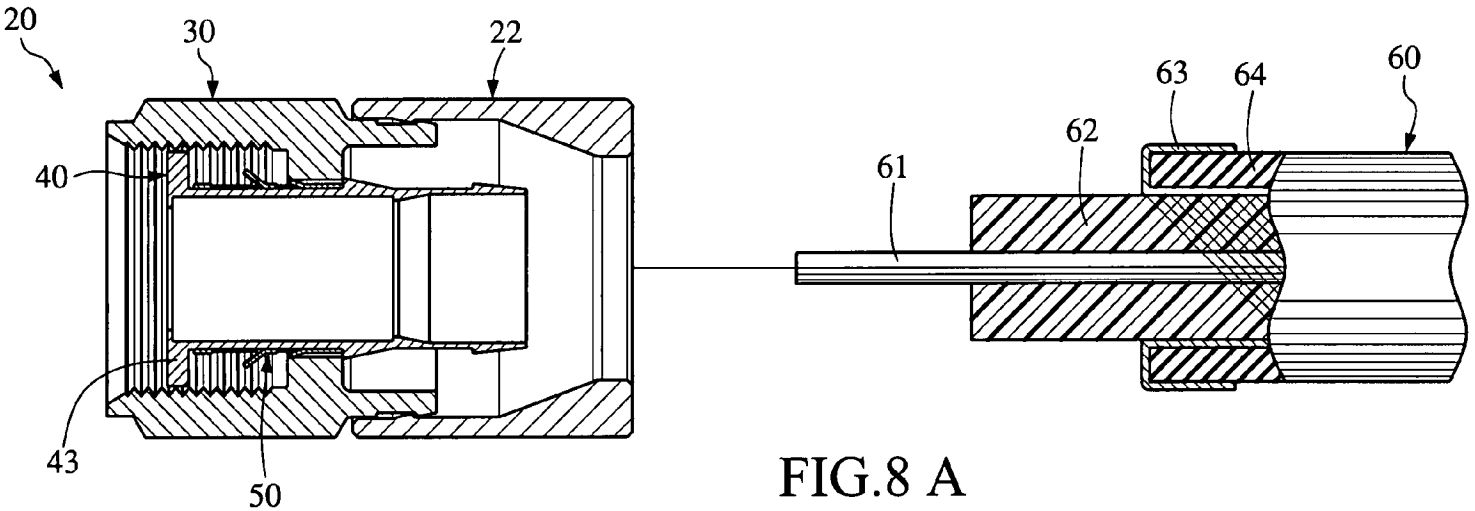
FIGS. 8A to 8C illustrate the manner of installing the connector of the present invention on a coaxial cable.

As can be seen in FIG. 4, which is a sectional view of the outer sleeve 22, the outer sleeve 22 includes a main body 23 internally defining a bore 24. The bore 24 has an inner diametrical size large enough for receiving a partial length of the connecting ring 30 therein. A circle of rearward tapered conical inner wall portion 25 is formed in and around the bore 24 near a front end thereof. A radially inward annular flange 26 is formed in the main body 23 of the outer sleeve 22 adjacent to a rear end of the bore 24, and the annular flange 26 defines an opening 27 therein. The opening 27 has a diametrical size large enough for receiving a free end of a coaxial cable 60 therein, as can be seen in FIG. 8A.

Figure 5:
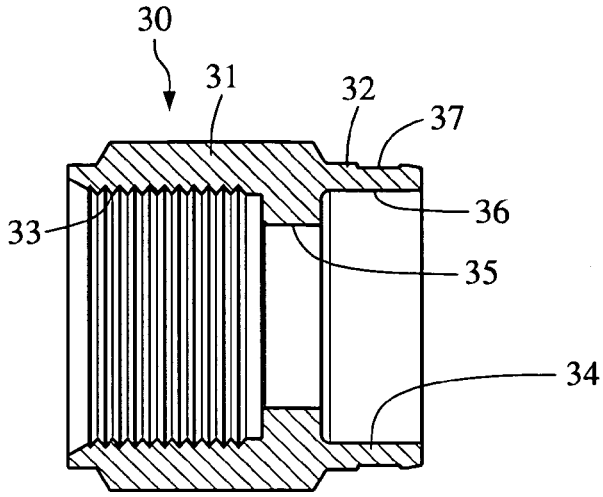
FIG. 5 is a sectional view of a connecting ring included in the electrical connector of the present invention.

FIG. 5 is a sectional view of the connecting ring 30. The connecting ring 30 is located at a front end of the connector 20, and can be used in differently configured connecting interfaces, such as F, BNC, RCA, and IEC connectors. In the illustrated embodiment, the connecting ring 30 is used in an F connector. The connecting ring 30 includes a front screwing body 31 having a hexagonal outer face, and a rear hollow cylindrical portion 32. The hexagonal front screwing body 31 is internally provided with screw threads 33 and a circle of radially inward flange 34. The screw threads 33 can mesh with a mating connecting interface on an electronic device, so that the electronic device is mechanically and electrically connected to the coaxial cable 60 via the connector 20. The inward flange 34 defines a bore 35 for the conductive grounding element 50 to pass therethrough.

The rear hollow cylindrical portion 32 internally defines a bore 36, which has a diametrical size large enough for receiving a braided conductive grounding sheath 63 and an insulating sheath 64 of the coaxial cable 60 between the rear hollow cylindrical portion 32 and the inner sleeve 40. An annular groove 37 is formed around an outer wall face of the hollow cylindrical portion 32. When the hollow cylindrical portion 32 of the connecting ring 30 is inserted into the bore 24 of the outer sleeve 22, the conical inner wall portion 25 in the outer sleeve 22 is received in and engaged with the annular groove 37, such that the connecting ring 30 is freely rotatably in the outer sleeve 22.

Figure 3:
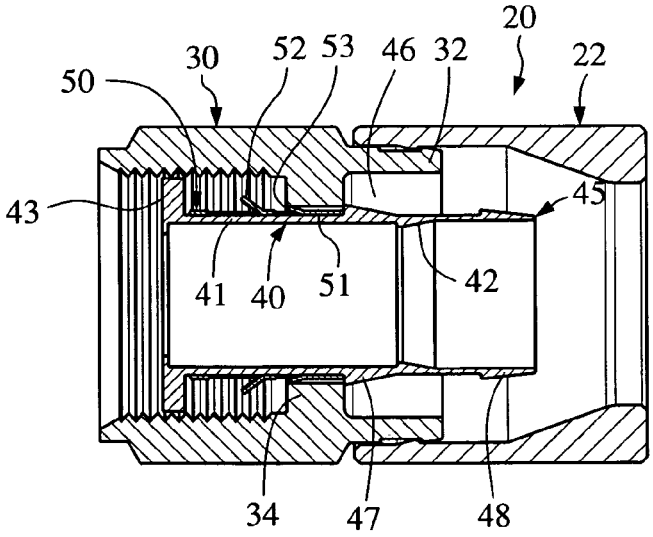
FIG. 3 is an assembled sectional view of the electrical connector of FIG. 2.
Figure 6:
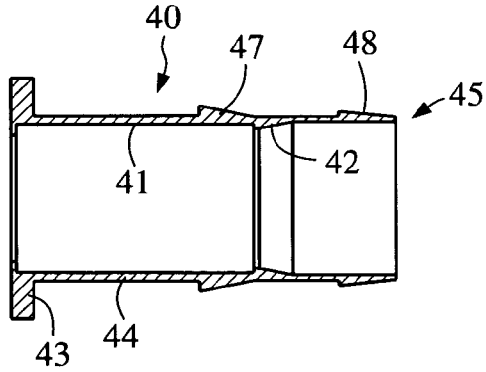
FIG. 6 is a sectional view of an inner sleeve included in the electrical connector of the present invention.

As shown in FIG. 6, the inner sleeve 40 defines a bore 41, which has a diametrical size large enough for receiving a central conductor 61 and an insulating spacer 62 of the coaxial cable 60 therein. An annular tooth 42 is formed around an inner wall surface of the bore 41 at a predetermined position with a sharp edge of the tooth 42 directed toward a front end of the inner sleeve 40 to prevent the coaxial cable 60 from moving out of the connector 20. The inner sleeve 40 includes a radially outward flange 43 formed around a front end thereof, an interfacing portion 44 behind the outward flange 43, and a slope-contained tubular portion 45 behind the interfacing portion 44. The interfacing portion 44 is sized for fitting in the conductive grounding element 50, and is coaxially located in the hexagonal front screwing body 31 of the connecting ring 32. The slope-contained tubular portion 45 is coaxially located in the bore 36 defined in the rear hollow cylindrical portion 32 of the connecting ring 30, such that the hollow cylindrical portion 32 is concentrically disposed around the slope-contained tubular portion 45 with an annular hollow space 46 formed between the cylindrical portion 32 and the slope-contained tubular portion 45, as shown in FIG. 3. The slope-contained tubular portion 45 includes a circle of rearward declined first slope 47 and a circle of rearward declined second slope 48 respectively externally formed at a front and a rear end thereof.

Figure 7:
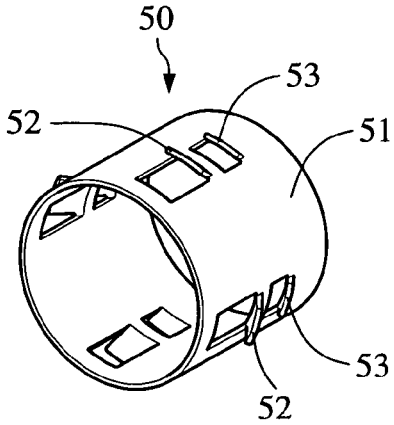
FIG. 7 is a perspective view of a conductive grounding element included in the electrical connector of the present invention.

Please refer to FIG. 7. The conductive grounding element 50 includes a tubular main body 51 for externally immovably fitting around the interfacing portion 44 of the inner sleeve 40. On the tubular main body 51, there is integrally formed a plurality of front elastic leaves 52 and a plurality of rear elastic leaves 53. In the illustrated embodiment, there are four front elastic leaves 52 and four rear elastic leaves 53 respectively circumferentially and equally spaced along a wall of the tubular main body 51.

The front and the rear elastic leaves 52, 53 are formed on the conductive grounding element 50 by radially outward punching the wall of the tubular main body 51. As shown in FIG. 3, before the assembled connector 20 is connected to the coaxial cable 60, the inward flange 34 of the connecting ring 30 is located between the rear elastic leaves 53 of the conductive grounding element 50 and the first slope 47 of the inner sleeve 40, so that the inner sleeve 40 is not freely axially movable. However, when a rearward pull is applied to the inner sleeve 40, the rear elastic leaves 53, due to the elasticity thereof, can be radially inward compressed by the inward flange 34 to thereby pass through the bore 35 defined in the inward flange 34. Thereafter, the front elastic leaves 52 are also radially inward compressed by the inward flange 34 to pass through the bore 35. Finally, the outward flange 43 of the inner sleeve 40 is pressed against the inward flange 34 of the connecting ring 30 under the pull and the inner sleeve 40 can no longer be axially moved rearward. At this point, the front elastic leaves 52 will spring radially outward to a predetermined position for electrically contacting with the inward flange 34.

Figure 8B:
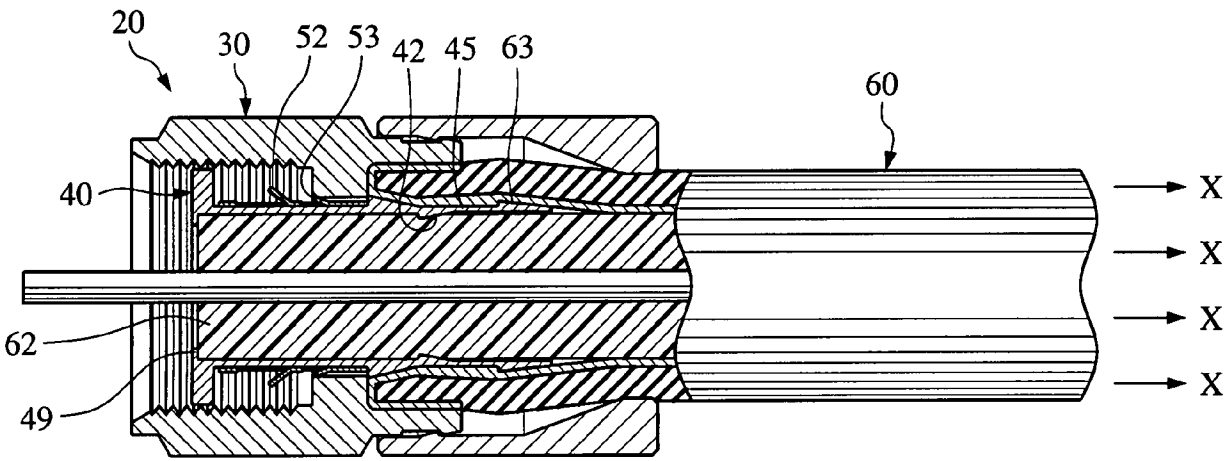
Figure 8C:
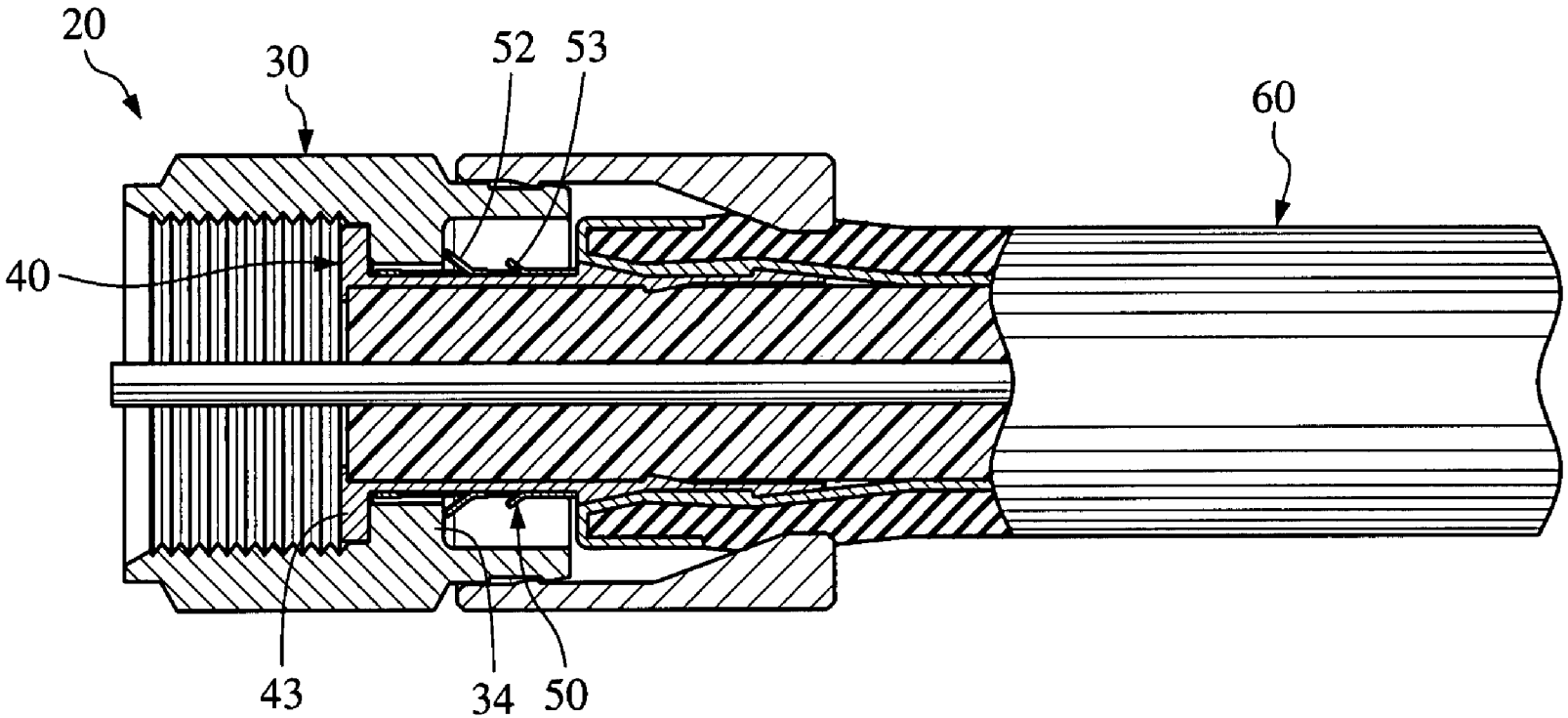

FIGS. 8A to 8C show the manner of installing the connector 20 on the cable 60. The cable 60 includes, from outer to inner side, the insulating sheath 64, the braided conductive grounding sheath 63, the insulating spacer 62, and the central conductor 61. Please refer to FIG. 8A. Before installing the connector 20, first strip a length of the insulating sheath 64 from a free end of the cable 60, and turn part of the exposed braided conductive grounding sheath 63 backward to expose a length of the insulating spacer 62 and the central conductor 61. Meanwhile, the outward flange 43 on the inner sleeve 40 of the connector 20 before installing is located at a first position closer to a front end of the connecting ring 30. Then, as shown in FIG. 8B, the stripped free end of the coaxial cable 60 as prepared in FIG. 8A is inserted into the inner sleeve 40 to contact a front end of the insulating spacer 62 with a flat inner end surface 49 of the front end of the inner sleeve 40. While inserting the cable 60 into the inner sleeve 40, the slope-contained tubular portion 45 of the inner sleeve 40 is forced into between the braided conductive grounding sheath 63 and the insulating spacer 62 of the cable 60. With the slope-contained tubular portion 45 of the inner sleeve 40 extending between the braided conductive grounding sheath 63 and the insulating spacer 62, the circular tooth 42 is forced against an outer circumferential surface of the insulating spacer 62 to tightly engage with the insulating spacer 62, bringing the inner sleeve 40 to firmly mechanically connect to the cable 60, so that the free end of the cable 60 is held in the connector 20.

Then, a force in the direction as indicated by the arrows X in FIG. 8B is applied to the coaxial cable 60, so that the cable 60 is moved into a final connected position in the connector 20, as shown in FIG. 8C. When pulling the cable 60 as shown in FIG. 8B, the outward flange 43 of the inner sleeve 40 is simultaneously moved backward from the first position closer to the front open end of the connecting ring 30 to a second position, at which the outward flange 43 of the inner sleeve 40 is abutted on the inward flange 34 of the connecting ring 30. When the inner sleeve 40 is axially moved rearward, the front and rear elastic leaves 52, 53 on the conductive grounding element 50 are radially inward compressed by the inward flange 34 to thereby rearward pass through and locate behind the inward flange 34. At this point, the front elastic leaves 52 are electrically contacted at free ends with the inward flange 34 of the connecting ring 30 to establish good grounding contact between them to ensure good signal transmission quality and good electrical characteristic of the connector 20.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An electrical connector ensuring effective grounding contact for mechanically and electrically connecting a cable to a mating connecting interface on an electric device, the cable including a central conductor, an insulating spacer surrounding the central conductor, at least one layer of braided conductive grounding sheath surrounding the insulating spacer, and an insulating sheath surrounding the braided conductive grounding sheath; the connector comprising:

an inner sleeve and an outer sleeve coaxially located around the inner sleeve; the inner sleeve being adapted to receive the central conductor and the insulating spacer of the cable therein, the outer sleeve being adapted to receive the braided conductive grounding sheath and the insulating sheath therein, and the inner sleeve being axially rearward movable from a first position to a second position; and a conductive grounding element being externally immovably fitted around the inner sleeve, the conductive grounding element including a tubular main body, the tubular main body having a plurality of front elastic leaves and a plurality of rear elastic leaves formed thereon;

whereby when a stripped free end of the cable is inserted into the connector and the cable is rearward pulled, the inner sleeve is simultaneously rearward moved from the first position to the second position, forcing the inner sleeve, the conductive grounding element, and a connecting ring coaxially mounted around the inner sleeve to electrically contact with one another.

2. The electrical connector, as claimed in claim 1, wherein the inner sleeve includes a radially outward flange formed around a front end thereof, and the connecting ring internally includes a radially inward flange; whereby when the inner sleeve is moved from the first position to the second position, the front and the rear elastic leaves are radially inward compressed by the inward flange of the connecting ring to rearward pass through the inward flange, and when the inner sleeve reaches at the second position, the outward flange of the inner sleeve and the front elastic leaves are in electrical contact with the inward flange of the connecting ring.

3. The electrical connector ensuring effective grounding contact for mechanically and electrically connecting a cable to a mating connecting interface on an electric device, the cable including a central conductor, an insulating spacer surrounding the central conductor, at least one layer of braided conductive grounding sheath surrounding the insulating spacer, and an insulating sheath surrounding the braided conductive grounding sheath; the connector comprising:

an inner sleeve and an outer sleeve coaxially located around the inner sleeve; the inner sleeve being adapted to receive the central conductor and the insulating spacer of the cable therein, the outer sleeve being adapted to receive the braided conductive grounding sheath and the insulating sheath therein, and the inner sleeve being axially rearward movable from a first position to a second position; and a conductive grounding element being externally immovably fitted around the inner sleeve;

whereby when a stripped free end of the cable is inserted into the connector and the cable is rearward pulled, the inner sleeve is simultaneously rearward moved from the first position to the second position, forcing the inner sleeve, the conductive grounding element, and a connecting ring coaxially mounted around the inner sleeve to electrically contact with one another; and wherein the inner sleeve is formed around an inner wall surface at a predetermined position with an annular tooth, such that when the free end of the cable is fully inserted into the connector, the annular tooth is forced to tightly press against and accordingly associate with the insulating spacer of the cable.

* * * * *